US008511101B1

(12) United States Patent
Seymour

(10) Patent No.: US 8,511,101 B1
(45) Date of Patent: Aug. 20, 2013

(54) ICE MACHINE DELIVERING ICE ON DEMAND

(75) Inventor: Kerry Seymour, Montozuma, GA (US)

(73) Assignee: Kooler Ice, Inc., Byron, GA (US)

( * ) Notice: Subject to any disclaimer, the term of this patent is extended or adjusted under 35 U.S.C. 154(b) by 908 days.

(21) Appl. No.: 11/906,651

(22) Filed: Oct. 3, 2007

(51) Int. Cl.
*B65B 63/08* (2006.01)
*F25C 5/18* (2006.01)

(52) U.S. Cl.
USPC ..... 62/60; 62/340; 62/344; 53/127; 141/82; 426/393

(58) Field of Classification Search
USPC ..... 62/340, 344, 60; 53/127; 141/82; 426/393
See application file for complete search history.

(56) References Cited

U.S. PATENT DOCUMENTS

| | | | | |
|---|---|---|---|---|
| 4,333,612 | A * | 6/1982 | Hayashi | 241/33 |
| 5,088,300 | A * | 2/1992 | Wessa | 62/340 |
| 5,630,310 | A * | 5/1997 | Chadwell | 53/502 |
| 6,093,312 | A * | 7/2000 | Boulter | 210/86 |
| 6,112,539 | A | 9/2000 | Colberg | |
| 6,266,945 | B1 | 7/2001 | Schroeder | |
| 6,904,946 | B2 | 6/2005 | James | |
| 6,932,124 | B2 | 8/2005 | Dalton | |
| 7,624,773 | B2 * | 12/2009 | Maxwell | 141/114 |
| 2004/0079103 | A1 * | 4/2004 | Hawkes et al. | 62/340 |
| 2004/0216481 | A1 * | 11/2004 | James et al. | 62/344 |
| 2006/0005553 | A1 * | 1/2006 | Metzger | 62/135 |
| 2006/0207271 | A1 * | 9/2006 | Elsom et al. | 62/137 |
| 2007/0175235 | A1 * | 8/2007 | Metzger | 62/344 |
| 2008/0283145 | A1 * | 11/2008 | Maxwell | 141/114 |

* cited by examiner

*Primary Examiner* — Frantz Jules
*Assistant Examiner* — Cassey D Bauer
(74) *Attorney, Agent, or Firm* — McClure, Qualey & Rodack, LLP

(57) ABSTRACT

An ice machine in which an icemaker sits atop the ice machine and makes ice that is processed by the ice machine to deliver on demand ice in bags to a paying customer. The customer places payment into the money acceptor and pushes a button indicating a demand to purchase an open bag of ice or a container of ice water provided by the ice water dispenser.

12 Claims, 6 Drawing Sheets

ICE MACHINE DELIVERING ICE ON DEMAND

BACKGROUND

Historically, commercial or retail establishments have used ice that is derived from an ice bagging machine, pre-bagged ice, ice machine or ice vending machine. Often pre-bagged ice, whether made offsite from an ice bagging machine and shipped to a retail site or bagged onsite and stored in bagged form, is frozen hard and it is days and weeks old before a customer can obtain them through a dispenser box. Such pre-bagged hard ice is stale and can undesirably take on odors during storage or transport. Also, prebagged ice often agglomerates into chunks of ice that are too large for the customer to readily use e.g. they will no longer fit into a cup or pitcher, which forces the customer to take additional efforts to reduce the ice agglomerate size before use.

To accommodate the customer's needs, ice is provided for consumption via an ice machine. Typically, the ice machine is a large dispensing box where there is a bin full of ice and a scoop for retrieving the ice. A customer reaches inside this bin with the scoop and retrieves ice to deposit into an ice bucket or ice chest. This open-air type of ice dispensing exposes the ice to a variety of potentially unfavorable and even unhealthy conditions. These unhealthy conditions stem from contact with the customer's hands, the bucket or chest and water borne bacteria.

Ice vending machines only address part of the issues of unhealthy conditions surrounding the dispensing of ice. Generally, ice vending machines are in hotels, motels and the like. They dispense ice vertically into small open containers. This method of dispensing ice addresses the issue of human hands coming in contact with the ice but says little about possible contamination of the small container.

Thus, it is desirable to provide an apparatus whereby a customer can receive fresh-bagged ice conveniently, at any time of day or night. It is also desired, that the source of ice be made onsite to avoid the cost, expense and time lag of transporting pre-bagged ice to a retail site where customers may purchase it.

SUMMARY

The present invention is an ice machine. The present invention has a substantially rectangular housing. The rectangular housing has side panels that lift off to gain access to the interior of the housing. The interior of the housing is maintained at a constant thirty-four degrees Fahrenheit when the ice machine is in operation. If the ice machine interior temperature rises above thirty-four degrees, a preprogrammed refrigeration cycle begins to reduce the temperature to thirty-four degrees. If the temperature drops below thirty-four degrees, a preprogrammed defrost cycle begins to elevate the temperature to thirty-four degrees.

An icemaker sits atop the ice machine and makes ice that is processed by the ice machine to deliver on demand ice in ten or twenty pound bags to a paying customer. The quantity of ice may, if desired, be in the ten or twenty pound bag or any multiple of ten via selected programming. The customer places coins or folding money into the money acceptor and pushes a button indicating a demand to purchase an open bag of ice or a container of ice water provided by the ice water dispenser.

When taken in conjunction with the accompanying drawings and the appended claims, other features and advantages of the present invention become apparent upon reading the following detailed description of the embodiment of the invention.

BRIEF DESCRIPTION OF THE DRAWINGS

The invention is illustrated in the drawings in which like reference characters designate the same or similar parts throughout the figures of which.

DETAILED DESCRIPTION

Figure 1:
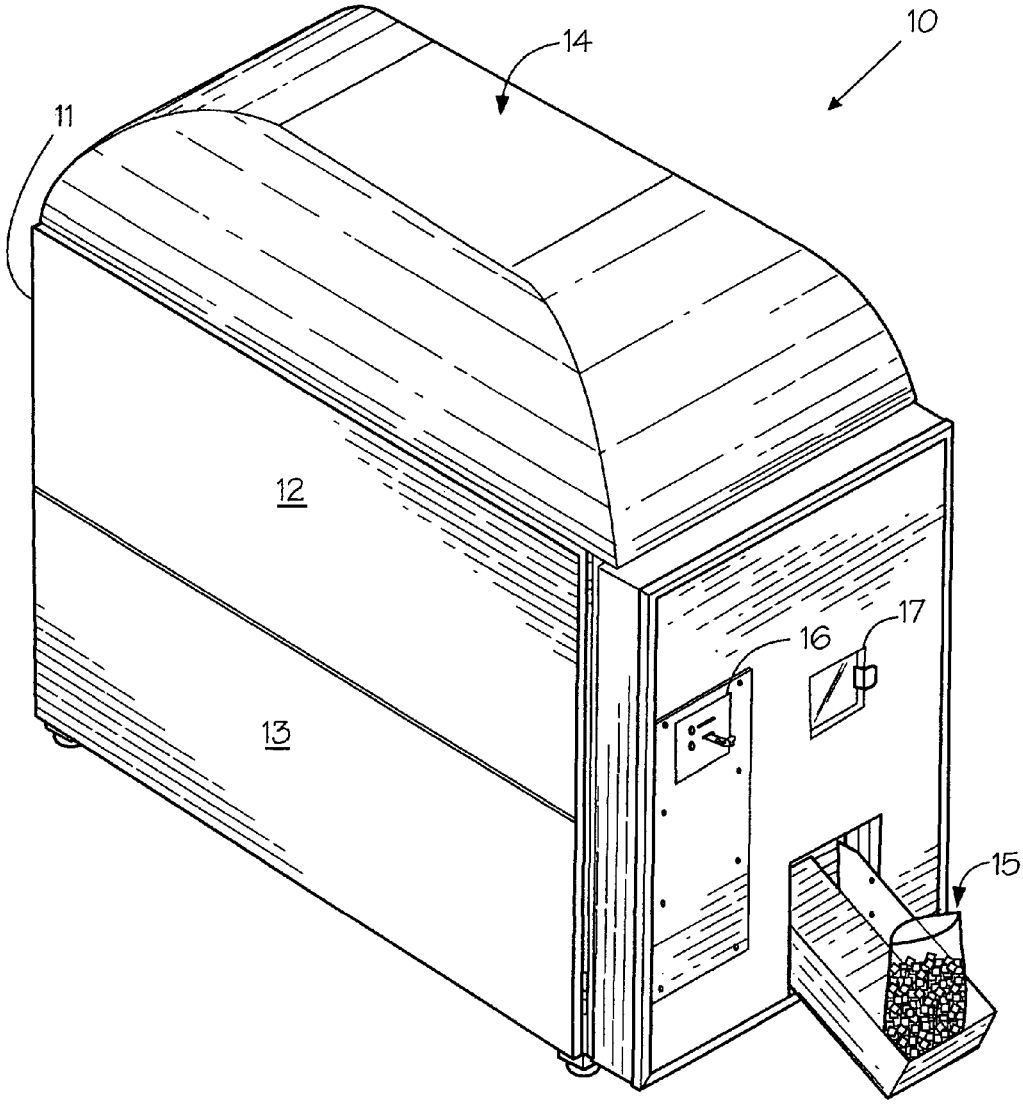
FIG. 1 illustrates a top-level perspective view diagram of the present invention.

An overview of the present invention: The present invention 10, FIG. 1 is an ice machine. The present invention 10 has a substantially rectangular housing 11. The rectangular housing 11 has side panels 12 and 13 that lift off to gain access to the interior of the housing. The interior of the housing 11 is maintained at a constant thirty-four degrees when the, ice machine is in operation. If the ice machine interior temperature rises above thirty-four degrees, a preprogrammed refrigeration cycle begins to reduce the temperature to thirty-four degrees. If the temperature drops below thirty four degrees, a preprogrammed defrost cycle begins to elevate the temperature to thirty-four degrees.

An icemaker 14 sits atop the ice machine and makes ice that is processed by the ice machine to deliver on demand ice in ten or twenty pound bags 15 to a paying customer. The quantity of ice may, if desired, be in the ten or twenty pound bag or any multiple of ten via selected programming. The customer places coins or folding money into the money acceptor 16 and pushes a button indicating a demand to purchase an open bag of ice or a container of ice water provided by the ice water dispenser 17.

Figure 2:
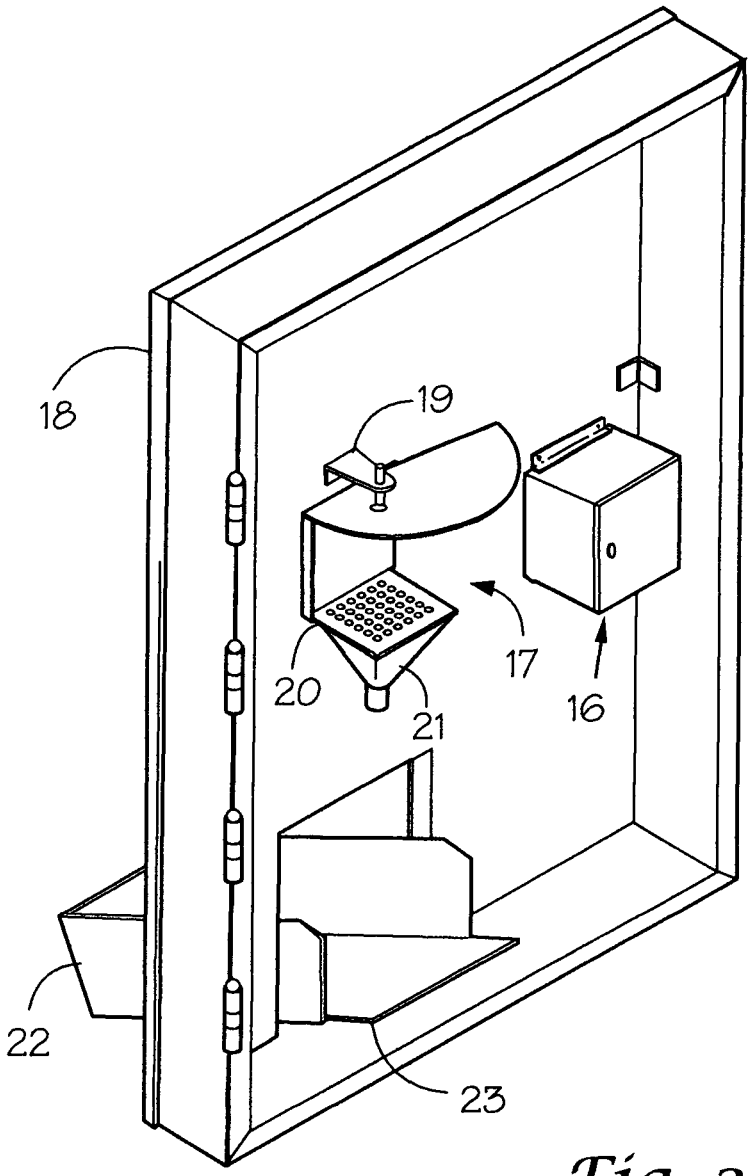
FIG. 2 illustrates a top-level perspective view diagram of the interior portion of the door of FIG. 1.

A more detailed discussion of the present invention: The present invention 10 has a hinge mounted door 18, FIG. 2. The door 18 is mounted on the front of the ice machine and swings open to allow access to the interior of the machine. An ice bag chute 22 is mounted in the door 18. An upper portion of the chute 22 extends into the interior of the ice machine. This portion of the chute 22 receives the open ice bag 15 in a horizontal position. The customer retrieves the open bag of ice 15 and may, if desired, exit with the open bag of ice 15 or secure the top of the bag with a twist tie. The ice water dispenser 17 is mounted on the door 18 by a hinge 19 and swings open allowing a container to be placed on a perforated table 20. The chilled water is delivered to the container via a chilled water tank. The chilled water tank may, If desired, be any convenient size to accommodate a plurality of water containers being successively filled with chilled water. Any spilled water will drain via a drain port 21 to the floor of the ice machine and exit via a drain pipe located in the rear of the machine.

Figure 3:
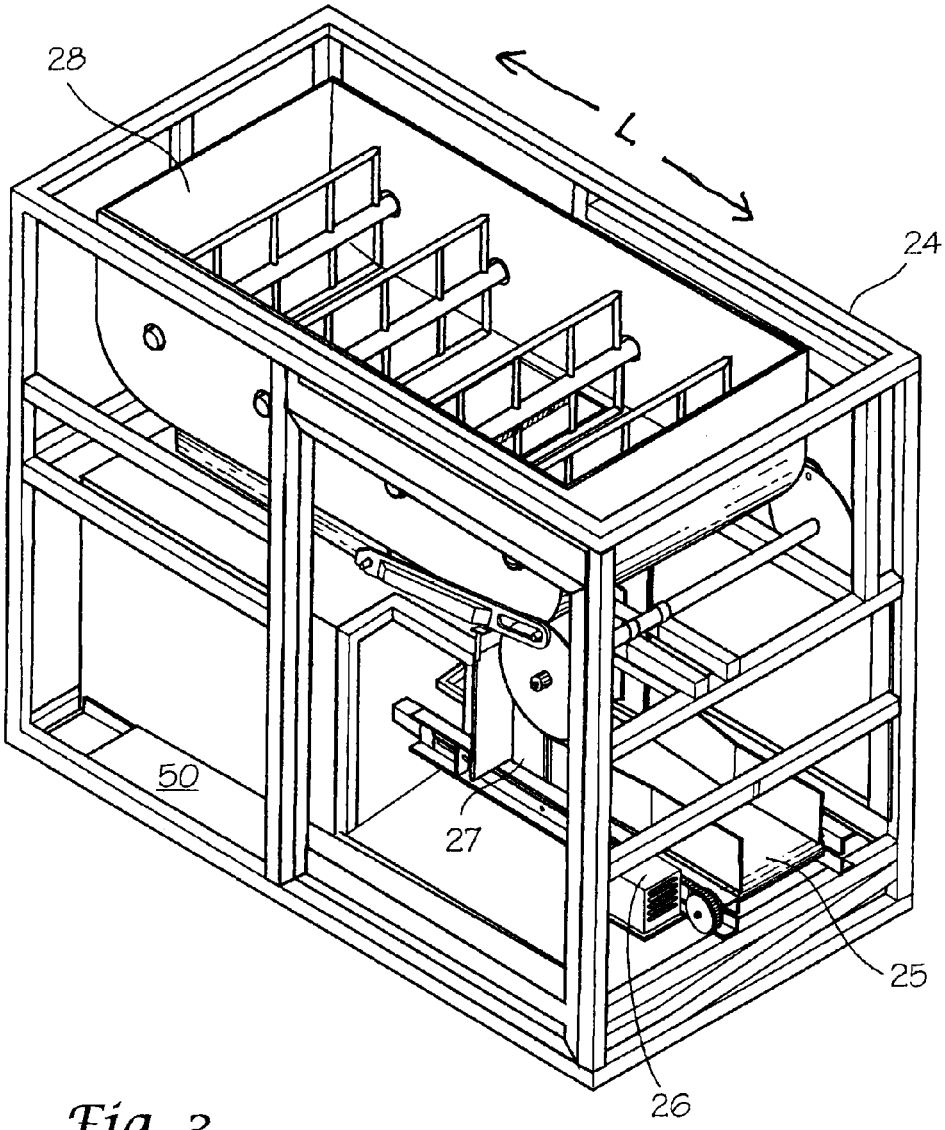
FIG. 3 illustrates a top-level perspective view diagram of the frame structure of FIG. 1.
Figure 4:
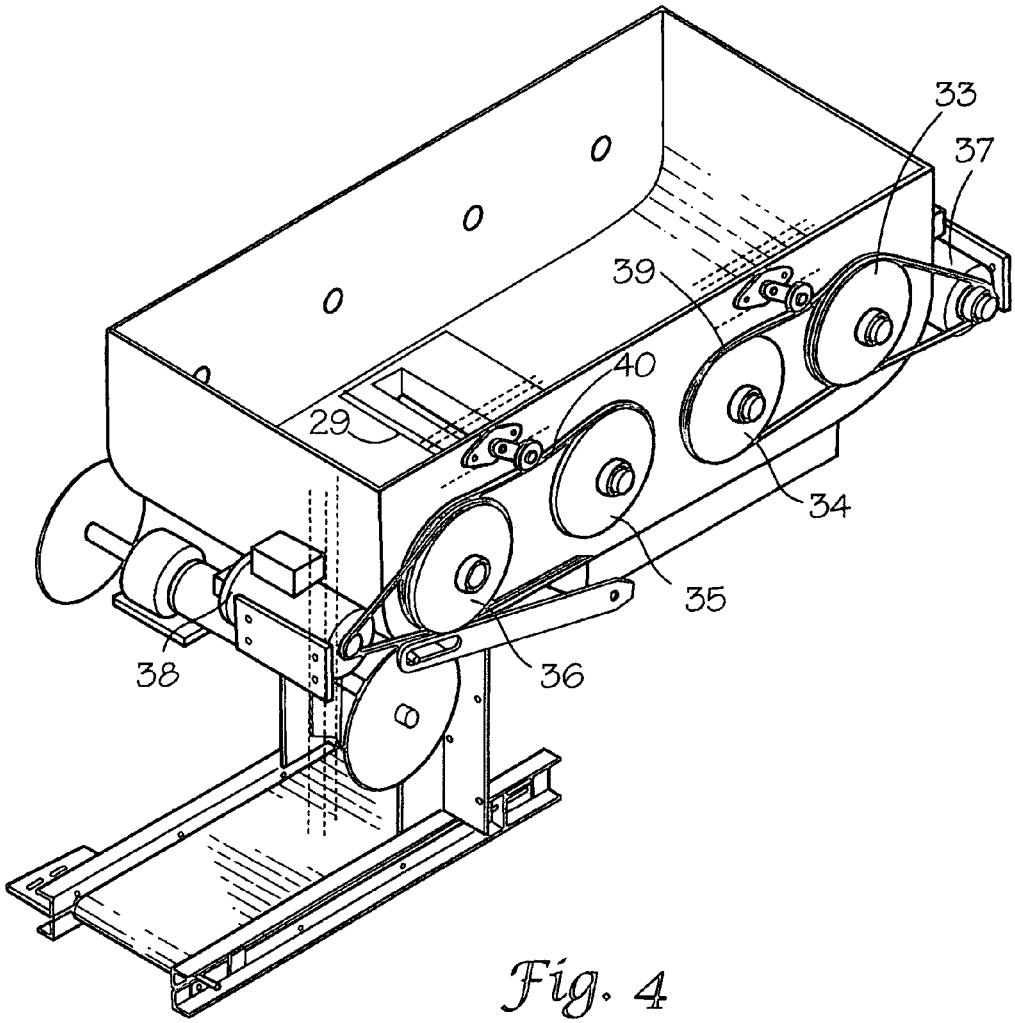
FIG. 4 illustrates a top-level perspective view diagram of the bin and drive motors for the tines of FIG. 1.

The internal components of the ice machine are all mounted to frame 24, FIG. 3. The frame 24 is parallel to the horizontal but the internal components of the ice machine are mounted at a 3 to 5 degree angle with the frame 24. This elevation allows not only the excess water from the ices water dispenser 17 to flow to the rear of the ice machine but any condensation that forms on the internal components of the ice machine is allowed to drain to the rear of the ice machine and exit via a drain pipe.

Conveyor 25, FIG. 3 is mounted to frame 24 and is powered' by motor 26. The front edge of conveyer 25 is adjacently positioned to the forward edge 23 of chute 22. The conveyer 25 rotates the bag 15 of ice from a vertical position to a horizontal position and conveys the bag down chute 22 to the awaiting customer. The other end of the conveyor 25 is adjacently positioned to ice bag chute 22 where the ice bag 15 is filled from the ice contained in bin 28 via slot 29.

Figure 5:
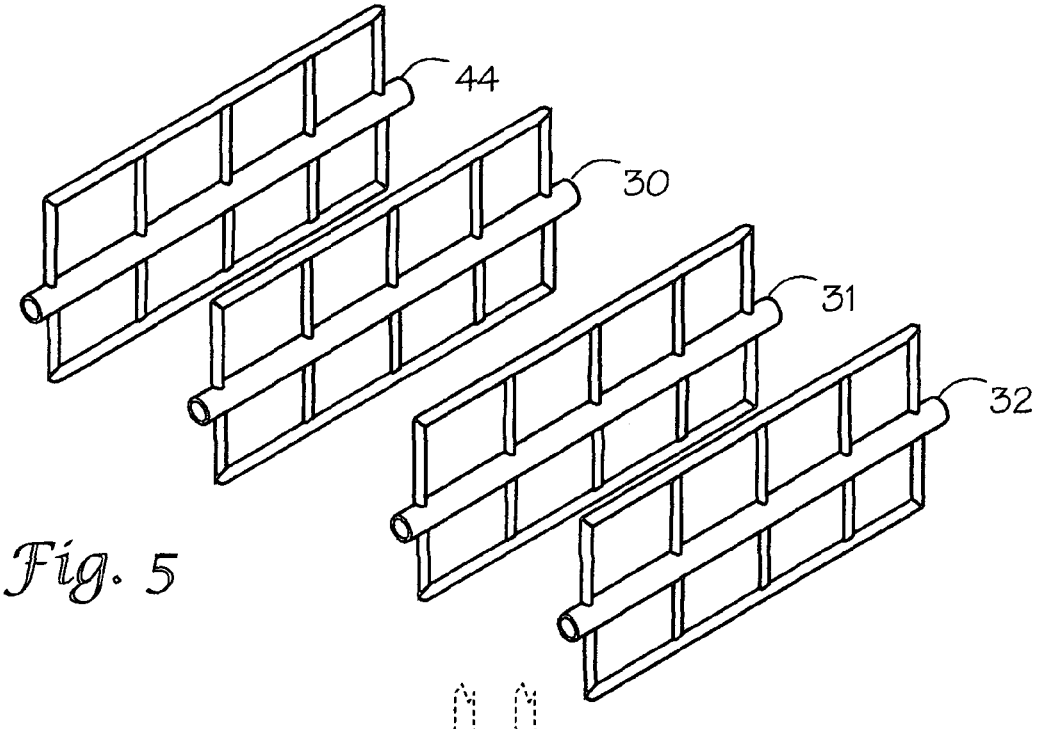
FIG. 5 illustrates a top-level perspective view diagram of the tines of FIG. 1.
Figure 6:
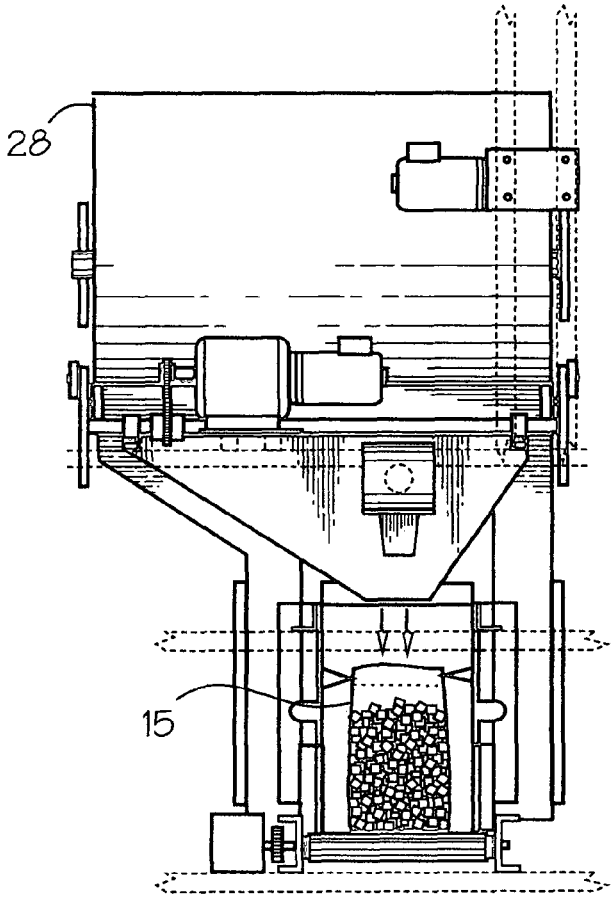
FIG. 6 illustrates a top-level end view diagram of the bin of FIG. 1.
Figure 7A:
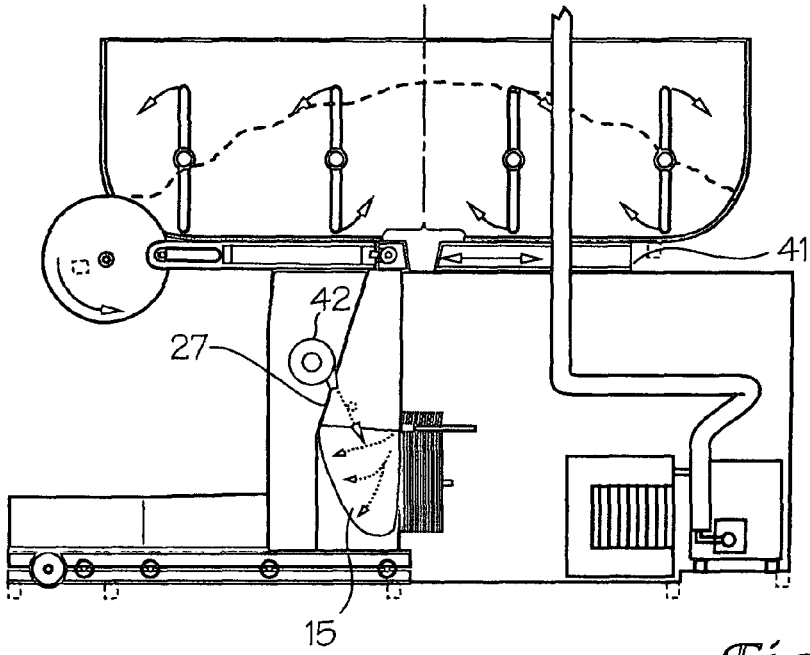
FIG. 7A illustrates a top-level side view diagram of the first position for the drawer.
Figure 7B:
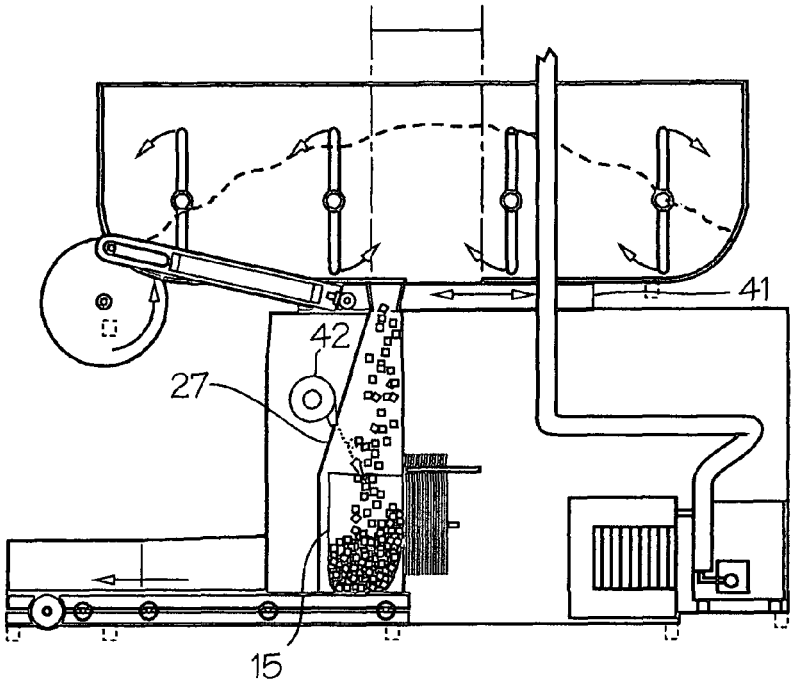
FIG. 7B illustrates a top-level side view diagram of the second position for the drawer.

Bin 28, FIG. 6 has four tines 44, 30, 31 and 32, FIG. 5. Each tine fork is substantially L-shaped and has one end mounted to the central column of its respective tine. As shown in FIGS. 3, 7A, and 7*b*, the tines are substantially regularly spaced throughout the length of bin 28, the length being indicated by the arrow L in FIG. 3; in other words, the length spanning from the front of the machine where the ice bag is delivered to the customer toward the rear of the machine where the drain is located. One end of each tine is connected to a cogwheel. The cogwheels 33 and 34 are driven by motor 37 via chain drive 39 and cogwheels 35 and 36 are driven by motor 38 via chain drive 40. Motor 37 drives tines 44 and 30 in the clockwise direction and motor 38 drives tines 31 and 32 in the counter clockwise direction. The collective clockwise and counter clockwise movement of the tines forces the ice in bin 28 to gravitate towards the center of the bin over slot 29.

In operation: Money is deposited in the money acceptor 16 and a poundage selection of ice desired is made. This action causes the tines 44, 30, 31 and 32, FIG. 7A to start their respective clockwise and counter clockwise churning of the ice in bin 28. The bag that retains the ice is blown open by fan motor 42 and is placed over one end of chute 27. A drawer 41, FIG. 7A has a first position where the drawer is open to the ice and closed to the bag. In this position the slot 29 is filled with a volume ice. The second position the drawer 41, FIG. 7B is closed to the ice and opened to the bag so that the full volume of ice collected in slot 29 during the first position is gravity fed into the bag during the second position.

Although an exemplary embodiment of this invention has been described in detail above, those skilled in the art will readily appreciate that many modifications are possible in the exemplary embodiment without materially departing from the novel teachings and advantages of this invention. Accordingly, all such modifications are intended to be included within the scope of this invention as defined in the following claim, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An ice machine for delivering ice on demand to a customer comprising:

a housing having an ice maker operationally disposed therein, said housing having a discharge outlet for discharging a filled bag of ice;

an ice bin disposed below said ice maker having an open top for receiving ice from said ice maker and a bottom opening for discharging ice;

two pairs of tines rotatably mounted in said ice bin, a first pair rotatable in one direction and a second pair rotatable in the opposite direction from the first for churning the ice in the bin, said first pair of tines comprise two distinct axis of rotation, said second pair of tines comprise two distinct axis of rotation, said pairs of tines being substantially equally spaced throughout the length of said bin;

a first motor for rotating said first pair in one direction and a second motor for rotating said second pair in the opposite direction;

an ice receiving drawer disposed below said ice bin for receiving a selected quantity of ice, said drawer being movable between a first position where the drawer is open to said bottom opening and a second position where the drawer is closed to said bottom opening, said drawer further including a lower opening;

an ice retaining bag disposed below said lower opening for receiving ice from said drawer, and a conveyor for moving the filled bag to said discharge opening.

2. An ice machine as defined in claim 1 in which said filled bag is delivered to the customer unsealed.

3. An ice machine as defined in claim 1 and including a blower disposed in said housing for blowing air into said ice bag to cause the bag to open.

4. An ice machine as defined in claim 1 and including a water dispenser.

5. An ice machine as defined in claim 4 including a payment means for accepting a customer's payment for a bag of ice and/or water.

6. An ice machine as defined in claim 1 including a payment acceptor for receiving payment for a bag of ice, said payment acceptor being connected to said ice machine for beginning the ice bag filling operation.

7. An ice machine for delivering ice on demand to a customer comprising:

an ice maker for producing a quantity of ice;

an ice bin disposed below said ice maker having an open top for receiving ice from said ice maker and a bottom opening for discharging ice;

a plurality of tines rotatably mounted in said ice bin, at least one first tine rotatable in one direction and at least a second tine rotatable in the opposite direction from the first for churning the ice in the bin said plurality of tines comprise a first pair of tines having two distinct axis of rotation and a second pair of times having two distinct axis of rotation; said tines being substantially equally spaced from one another throughout the length of said bin;

a first motor for rotating said first tine in one direction and a second motor for rotating said second tine in the opposite direction;

an ice receiving drawer disposed below said ice bin for receiving a selected quantity of ice, said drawer being movable between a first position where the drawer is open to said bottom opening and a second position where the drawer is closed to said bottom opening, said drawer further including a lower opening;

an ice retaining bag disposed below said lower opening for receiving ice from said drawer, and a conveyor means for moving the filled bag to the consumer.

8. An ice machine as defined in claim 7 in which said filled bag is delivered to the customer unsealed.

9. An ice machine as defined in claim 7 and including a blower for blowing air into said ice bag to cause the bag to open.

10. An ice machine as defined in claim 7 and including a water dispenser.

11. An ice machine as defined in claim 10 including a payment means for accepting a customer's payment for a bag of ice and/or water.

12. An ice machine as defined in claim 7 including a payment acceptor for receiving payment for a bag of ice, said payment acceptor being connected to said ice machine for beginning the ice bag filling operation.

* * * * *